US005133532A

United States Patent [19]

Figiel et al.

[11] Patent Number: 5,133,532

[45] Date of Patent: Jul. 28, 1992

[54] METHOD AND APPARATUS FOR CONTROLLING TENSION IN A STRAP LOOP

[75] Inventors: Janusz Figiel, Mount Prospect; Peter Drabarek, Chicago, both of Ill.

[73] Assignee: Illinois Tool Works Inc., Glenview, Ill.

[21] Appl. No.: 597,550

[22] Filed: Oct. 11, 1990

[51] Int. Cl.[5] ..... B25B 25/00

[52] U.S. Cl. ..... 254/216; 254/213; 100/32; 100/29; 140/93.2

[58] Field of Search ..... 254/216, 213; 100/32, 100/29; 53/582, 592; 140/93.2, 93.4

[56] References Cited

U.S. PATENT DOCUMENTS

| | | | |
|---|---|---|---|
| 3,169,011 | 2/1965 | Rutty | 100/32 |
| 3,442,733 | 5/1969 | Vilcins | 100/29 |
| 3,648,739 | 3/1972 | Angarola | 140/93.2 |
| 3,654,033 | 4/1972 | Angarola et al. | 53/582 X |
| 3,669,799 | 6/1972 | Vilcins et al. | 156/359 |
| 3,679,519 | 7/1972 | Frey | 156/366 X |
| 3,709,758 | 1/1973 | Gilmore | 100/29 X |
| 3,944,460 | 3/1976 | Karr | 53/582 X |
| 4,015,643 | 4/1977 | Cheung | 254/216 X |
| 4,159,725 | 7/1979 | Bachmann et al. | 140/93.2 |
| 4,282,907 | 8/1981 | Massion et al. | 140/93.4 |

OTHER PUBLICATIONS

Signode, Operation, Parts and Safety Manual--E-186095 Models VFD 302 & VFD 304-6, Prior to Nov. 11, 1990.

Signode, Operation, Parts and Safety Manual-186096 VFL & VFM, Prior to Nov. 11, 1990.

Signode, Operation, Parts and Safety Manual-186121 AEC and AECW, Prior to Nov. 11, 1990.

*Primary Examiner*—Daniel P. Stodola
*Assistant Examiner*—Tony A. Gayoso
*Attorney, Agent, or Firm*—Schwartz & Weinrieb

[57] ABSTRACT

A method and apparatus for tensioning a strap loop around an object and terminating the tensioning of the strap loop at a predetermined loop tension. The object is encircled with a loop of strapping having a predetermined thickness, width, and coefficient of friction. A leading end portion of the strap is restrained while disposing a trailing end portion of the strap adjacent a traction wheel that is rotatable about a first axis at a predetermined maximum available torque. A pressing member that is pivotable about a second axis oriented parallel to the first axis and that has a predetermined configuration and coefficient of friction is biased toward the traction wheel so as to press the strap trailing end portion against the traction wheel. The traction wheel is rotated about the first axis so as to grip the strap and slide the strap along the pressing member for tensioning the strap loop while permitting the sliding friction force imposed upon the pressing member to pivot the pressing member further toward the traction wheel so as to further compress the strap between the traction wheel and pressing member so as to increase the sliding friction resistance force imposed upon the strap and thereby overcome the tangential force imposed upon the strap by means of the traction wheel at the maximum available torque so as to terminate the traction wheel rotation at the predetermined loop tension.

21 Claims, 2 Drawing Sheets

METHOD AND APPARATUS FOR CONTROLLING TENSION IN A STRAP LOOP

TECHNICAL FIELD

This invention relates to an apparatus and method for tensioning a loop of a strap tightly around an article to a predetermined tension level.

BACKGROUND OF THE INVENTION AND TECHNICAL PROBLEMS POSED BY THE PRIOR ART

A variety of tools are commonly used for tensioning a loop of metal or thermoplastic strapping around materials disposed upon a pallet, around a bale of material, around a package, or around other objects. Typically, a loop is first formed around the object. Next, the overlapping portions of the strap are engaged by means of the tool so as to tension the loop, and then the overlapping strap portions are joined together by means of the tool.

For some applications, it is desirable to tension the loop to a predetermined tension force. Various manual and automatic tools that have been proposed and/or that are commercially available include tension control mechanisms for terminating the tension at the desired level.

However, while many of these tools may normally function well in the applications for which they were originally intended, the tension control systems can add undue complexity to the tool. The complexity is typically manifested by means of an increased number of parts which are susceptible to failure or improper operation under typical field conditions involving careless or inexperienced operators and dirty operating environments which can clog or otherwise adversely affect the proper operation of the tension control mechanisms.

Accordingly, it would be desirable to provide an improved tension control mechanism that could be incorporated within a tool with a reduced number of parts and that would be less susceptible to operational failure or improper operation.

In some applications it is desirable to use thermoplastic strapping, and it would be beneficial if an improved tension control mechanism could be employed that would operate effectively with such thermoplastic strapping.

In some applications there is also a need to only develop a very low degree or level of tension within the loop, at least initially. For example, there are applications wherein highly compressible material is compressed within large presses so as to form bales, and the bales, while still compressed within the presses, are then encircled with strapping. In some cases the strapping is fed through means of channels defined within the press, and a number of such straps are longitudinally arranged along the length of the bale within the press.

Before the press is released, it is desirable to pull each strap loop so that it just touches the bale surface. Next, the overlapping strap portions of each loop are joined together, and the bale press is released so as to allow the bale to expand against the encircling strap loops.

In order to prevent overloading any one of the strap loops disposed around the bale, it is desirable, to the extent possible, to insure that each one of the loops disposed around the bale is substantially the same size as the other loops and is therefore subjected to substantially the same expansion (tension) forces as each one of the other strap loops. In order to insure that each strap loop has approximately the same size as the other loops before the press is released, it is necessary that a means be found so as to ensure that each one of the strap loops is effectively pulled out of the press channels and into contact with the surface of the compressed bale.

In order to make sure that a particular strap loop is pulled completely free of the encircling channel defined within the bale press, and in order to insure that the strap is in contact with the surface of the bale over the entire periphery of the bale, it has been determined that a predetermined nominal amount of tension should be applied to each strap loop. It is contemplated that for some large bale press applications, a nominal degree of tension of approximately 100 pounds force tension within the strap loop would be sufficient so as to insure that the strap loop is in contact with the entire periphery of the compressed bale before the press is released.

The tension force of approximately 100 pounds would be relatively low when compared to the compressibility of the already highly compressed bale. Thus, there would be no possibility that any substantial further compression of the bale would result from the development of the 100 pound tension within the strap loop.

Because no further substantial compression of the bale would occur when subjected to the relatively low, 100 pound force tension, the size of the loop disposed around the compressed bale would be substantially equal to the peripheral extent of the bale before the loop was tensioned around it to the 100 pound tension level. Thus, each one of the strap loops disposed upon the compressed bale should have a size equal to the peripheral extent of the compressed bale, and all of the loops should therefore be of substantially the same size. Therefore, when the bale press is released, all of the strap loops should be subjected to substantially the same maximum tension force.

It would be desirable to provide an improved tension control mechanism that would operate at relatively low strap tension forces so that such a mechanism could be employed within tools for tensioning and joining the strap loops about compressed bales as discussed above.

Furthermore it would be advantageous if such an improved tension control mechanism could be used effectively with thermoplastic strapping, including polyester strapping which can be optimally used in connection with the above-discussed compressed bale applications.

SUMMARY OF THE INVENTION

The foregoing and other objectives are achieved in accordance with the present invention through means of the provision of a method for tensioning a strap loop about an object and terminating the tension of the strap loop at a predetermined loop tension level. The object is encircled by means of a loop of strapping having a predetermined thickness, width, and coefficient of friction. A leading portion of the strap is restrained while a trailing portion of the strap is disposed adjacent to a traction wheel that is rotatable about a first axis at a predetermined maximum available torque. A pressing member is provided so as to be pivotable about a second axis oriented parallel to the first axis. The pressing member has a predetermined configuration and coefficient of friction. The pressing member is biased toward the traction wheel so as to press the strap trailing portion against the traction wheel.

The traction wheel is rotated about the first axis so as to grip the strap and slide the strap along the pressing member so as to tension the strap loop while permitting the sliding friction force imposed upon the pressing member to pivot the pressing member further toward the traction wheel. This movement further compresses the strap between the traction wheel and the pressing member, and this increases the sliding friction resistance force upon the strap. This results in the tangential tensioning force imposed upon the strap by means of the traction wheel being overcome at the maximum available torque level so as to terminate the traction wheel rotation at the predetermined loop tension.

In accordance with a preferred embodiment of the apparatus of the present invention for carrying out the above-described method of the invention, a restraining means, such as, for example a strap end gripper, is provided for restraining the leading portion of the strap.

A traction wheel, which is rotatable about a first axis, is provided adjacent to the trailing portion of the strap.

A pressing member is pivotably mounted about a second axis oriented parallel to the first axis and has a predetermined configuration and coefficient of friction.

A biasing means (such as, for example, a spring) is provided for biasing the pressing member toward the traction wheel so as to press the strap trailing portion against the traction wheel.

A motor means (such as, for example, an air motor) is operably associated with the traction wheel for rotating the traction wheel at the predetermined maximum available torque so as to grip the strap and slide the strap along the pressing member for tensioning the strap loop while permitting the sliding friction force imposed upon the pressing member to pivot the pressing member further toward the traction wheel so as to further compress the strap between the traction wheel and the pressing member. This increases the sliding friction resistance force upon the strap and overcomes the tangential force imposed upon the strap by means of the traction wheel at the maximum available torque so that the traction wheel rotation is terminated at the predetermined loop tension level.

BRIEF DESCRIPTION OF THE DRAWINGS

Numerous other advantages and features of the present invention will become readily apparent from the following detailed description of the invention, from the claims, and from the accompanying drawings, in which like reference characters designate like or corresponding parts throughout the several views, and wherein:

DESCRIPTION OF THE PREFERRED EMBODIMENT

While this invention is susceptible of embodiments in many different forms, this specification and the accompanying drawings disclose only one specific form as an example of the use of the present invention. The invention is not intended to be limited to the embodiment so described, and the scope of the invention will be defined by means of the appended claims.

For ease of description, the apparatus of this invention will be described in the normal (upright) operating position, and terms such as, for example, upper, lower, horizontal, and the like, are used with reference to this position. It will be understood, however, that the apparatus of this invention may be manufactured, stored, transported, used, and sold in an orientation other than the position described.

The apparatus of this invention can be used within tools having certain conventional components and control systems, the details of which, although not fully illustrated or described, will be apparent to those having skill in the art and an understanding of the necessary functions of such components.

Figure 1:
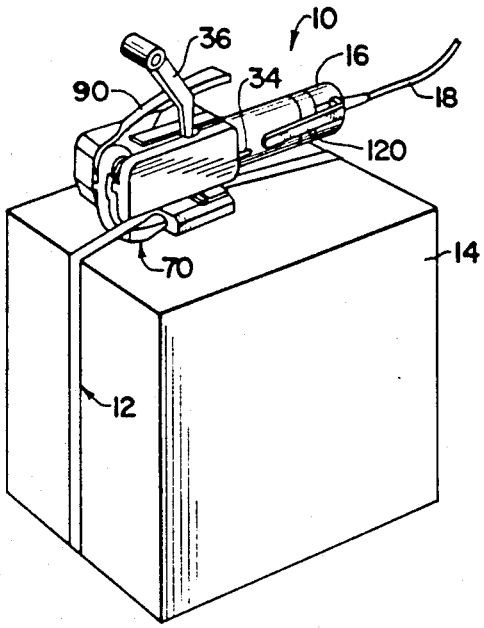
FIG. 1 is a simplified, perspective view of a tool incorporating the tension control mechanism of the present invention, and the tool is shown tensioning a strap loop about an object.

The tension control mechanism of the present invention can be incorporated within a strap loop tensioning tool as generally designated by means of reference numeral 10 in FIG. 1. The tool 10 is shown tensioning a loop of strapping 12 around an object 14.

The tension control mechanism of the present invention has been found to be especially suitable for use with a power tool operated by means of a conventional air motor 16 supplied with air by means of an air line 18. One conventional air motor that may be employed is that used in connection with the conventional strapping tool sold under the model designation VFT by Signode Corporation, 3600 West Lake Avenue, Glenview, Ill. 60025 U.S.A. The pneumatic timing circuit and tensioning drive system of the VFT tool are also especially suitable for use in connection with the tool 10 along with the novel tension control mechanism of the present invention. The details of such suitable conventional motors, timing circuits, and tensioning drive systems are well known to those having skill in the art and form no part of the tension control system of the present invention.

Figure 2:
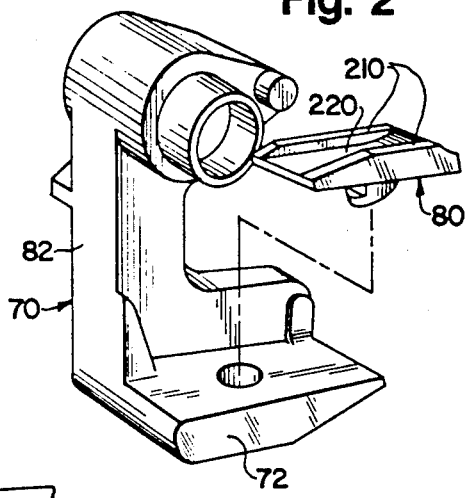
FIG. 2 is a greatly enlarged, side elevational view of the tool shown in FIG. 1 with portions of the tool broken away to better illustrate interior detail.

The tool 10 is adapted to engage the strap 12 in the manner best illustrated in FIG. 2. In particular, the strap 12 includes a leading end portion 22 which is positioned within the tool 10. The strap 12 encircles the object 14, and a trailing end portion 24 extends through the tool and overlaps the strap leading end portion 22.

The tool 10 includes a base portion 28 which supports a lower, toothed gripper 30 disposed beneath the strap leading end portion 22. A pivotable strap end gripper 32 projects laterally above the strap leading end portion 22 in registry with the toothed gripper 30. The gripper 32 can be pivoted downwardly and is biased by means of a suitable spring mechanism against the strap so as to hold the strap leading end portion 22 against the toothed gripper 30.

The gripper 32 can be maintained in an upwardly pivoted, "open" orientation so as to be disengaged from the strap leading end portion 22 by means of a suitable latch mechanism (not visible in the figures). The latch can be released so as to permit the gripper 32 to pivot downwardly and engage the strap leading end portion 22 by actuating a lever 34.

The gripper 32 can be returned to the latched open position by means of suitable return mechanisms, such as, for example, by moving an operating handle 36 to a forward, "home" position. The details of the mechanisms for moving the gripper 32 to the open position by means of the movement of the handle 36, for latching the gripper 32 in the open position, for releasing the gripper 32 from the latched open position, and for biasing the gripper 32 into engagement with the strap leading end portion 22 form no part of the tension control system of the present invention. Indeed, a variety of well-known, conventional strap gripper mechanisms may be adapted for use with the tool 10.

The tool base 28 also supports a lower strap weld pad 40. The weld pad 40 engages the lower surface of the strap leading end portion 22. Above the trailing end portion 24 of the strap 12 there is disposed a downwardly facing, upper strap weld pad 42. The weld pad 42 is adapted to be moved downwardly so that the overlapping strap portions 22 and 24 are pressed between the pad 42 and pad 40.

The upper pad 42 is also adapted to be vibrated transversely when disposed in the lowered position so as to be engaged with the straps and thereby vibrate the upper strap trailing end portion 24 transversely with respect to the strap length and relative to the lower strap leading portion 22. This produces a conventional friction-fusion welded joint within the thermoplastic strap in a conventional manner as is well known to those skilled in the art.

In one contemplated form of the tool 10, the handle 36 can be pulled rearwardly (from the left toward the right as viewed in FIG. 2) so as to move the upper weld pad 42 downwardly into the welding position and to effect the welding operation. The weld pads 40 and 42, along with the operating and control systems therefor, may be identical to those employed within the model VHT tool sold by the above-identified Signode Corporation. The weld pad structure, along with the associated operating and control system, form no part of the tension control system of the present invention.

The rear end of the upper weld pad 42 is preferably provided with a cutter 54 for severing the upper strap trailing end portion 24 during the welding process. An opposing, upwardly facing cutter 58 is provided below the upper strap trailing end portion 24. The lower cutter 58 is fixed upon the tool frame so that the strap leading end portion 22 can be threaded beneath the cutter 58 and so that the upper strap trailing end portion 24 can be threaded above it.

The cutters 54 and 58 are but one means that may be used to sever the strap trailing end portion 24. Other suitable conventional or special cutting mechanisms or systems may be employed, and such cutter systems form no part of the tension control system of the present invention. Indeed, if a precut length of strapping is to be formed into a loop, tensioned, and the overlapping ends joined together, then there may be no need to sever the small, trailing end portion of the strap.

Tension is developed within the strap loop by means of a traction wheel 60 which is mounted for rotation upon a shaft 62 mounted within the tool 10 and which defines a fixed axis of rotation. The axis of the traction wheel rotation is designated by means of the reference letter C in FIG. 4. The traction wheel 60 is driven through means of a suitable transmission or drive means (not illustrated) operatively associated with the motor 16 and known to those having skill in the art. The details of such a drive means form no part of the tension control system of the present invention.

The strap trailing end portion 24 is disposed adjacent to the traction wheel 60 and is maintained against the traction wheel 60 by means of a tensioning foot 70. The tensioning foot 70 includes a front portion 72 upon which is mounted a smooth gripper plug or pressing member 80 for contacting the lower surface of the strap trailing end portion 24 and for forcing the strap trailing end portion 24 against the cylindrical face of the traction wheel 60.

The tensioning foot 70 includes an upwardly extending leg portion 82 which is pivotally mounted at its upper end about a shaft 86 mounted within the frame of the tool 10. The pivot axis defined by means of the shaft 86 is designated by means of the reference letter P in FIG. 4.

The shaft 86 is fixed within the frame of the tool 10. The release lever 90 is connected to tensioning foot 70, and both the lever 90 and foot 70 are pivotally mounted together upon the shaft 86. When the release lever 90 is pushed downwardly toward the top of the tool, the tensioning foot 70, which is connected to the lever 90, likewise swings downwardly away from the traction wheel 60 so as to permit the strap to be inserted or removed. The tensioning foot 70 is normally biased against the traction wheel 60 by means of a torsion spring 96 which is engaged at one end thereof with a post 98 provided at the upper part of the tensioning foot 70 and which is engaged at the other end thereof with a lug 102 which extends from, and which is fixed to, the frame of the tool 10.

In operation, after the strap 12 is encircled around the object 14 and threaded through the tool 10 as illustrated, the gripper 32 is engaged with the strap leading end portion 22. The lever 90 is permitted to be pivoted upwardly (to the position illustrated in FIG. 2) by means of the spring 96 so that the tensioning foot 70 forces the strap trailing end portion 24 against the traction wheel 60. Next, the motor 16 is actuated so as to rotate the traction wheel 60 (counterclockwise as viewed in FIG. 2) in order to tension the strap loop. With a conventional air motor 16 of the type discussed above, the air motor may be actuated by pressing an operating lever 120. The rotating traction wheel 60 draws the strap 12 back through the tool 10 and tensions the loop tightly around the object 14.

According to the principles of the present invention, a novel technique is provided for automatically terminating the tension within the strap loop. The technique uses the characteristics of the strap 12, the gripper plug pressing member 80, and the traction wheel drive system so as to effect a self-limiting application of the tensioning force. In particular, for a strap having a predetermined thickness, width, and coefficient of friction, the pressing member 80 is designed with a predetermined configuration and coefficient of friction. The relationship defined between the pivot axis of the tensioning foot 70 and the rotational axis of the traction wheel 60 is selected so that after the desired loop tension has been effected, the maximum available torque applied to the traction wheel 60 is insufficient to develop any greater tension.

This technique will now be more specifically discussed with respect to a preferred embodiment of the present invention for use with thermoplastic strapping, and in particular, for use with polyester strapping having a width of approximately 0.625 in. and a thickness of approximately 0.032 in.

Figure 4:
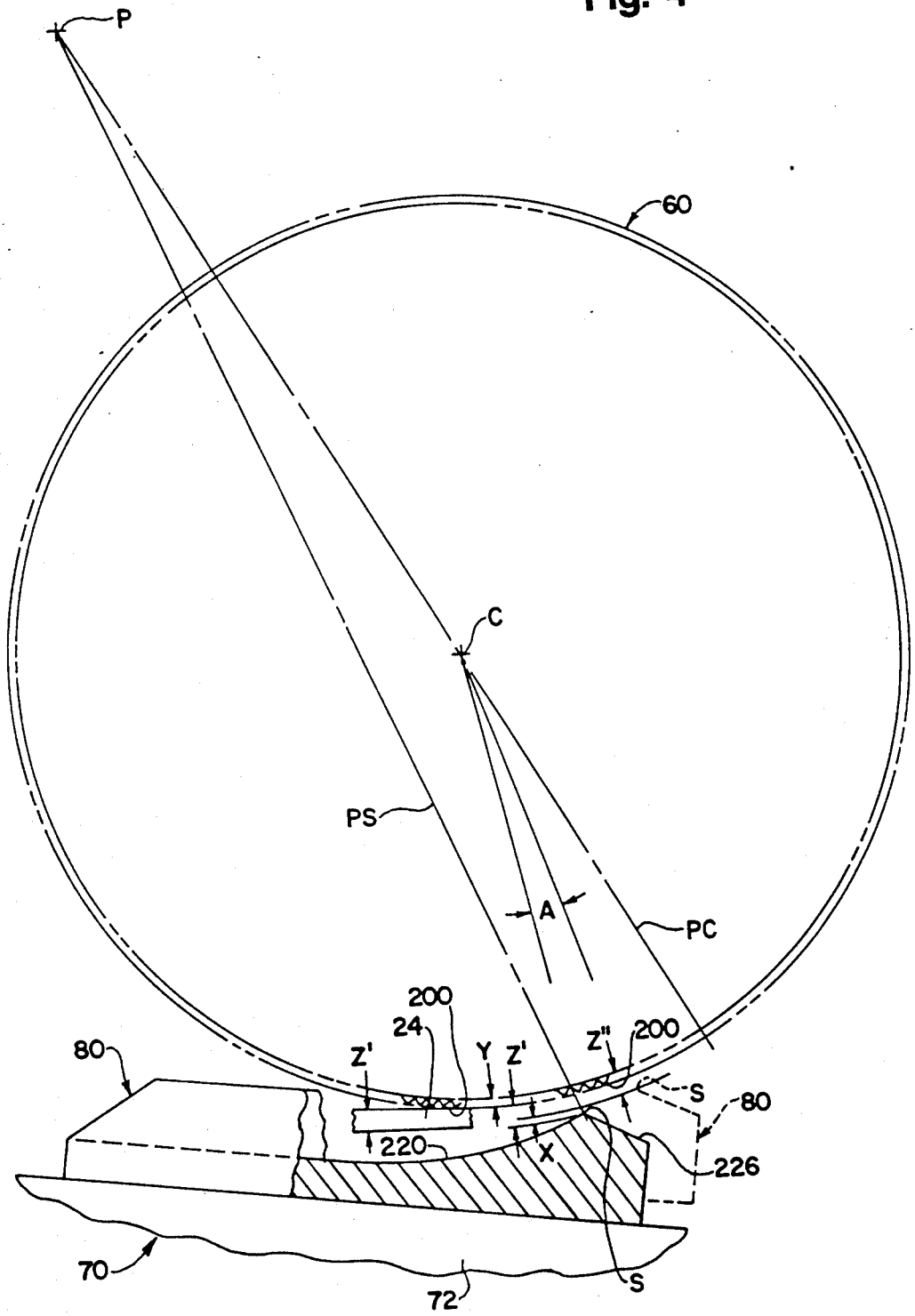
FIG. 4 is a simplified, side elevational view, partly on cross-section and in a greatly enlarged scale, of the pressing member and traction wheel shown partly diagrammatically so as to illustrate the tensioning process.

For use with such strapping, the cylindrical face of the traction wheel is provided with teeth 200 (FIG. 4). The teeth 200 are arranged in an array of rows in which the rows are spaced apart by approximately 0.06 in. Each tooth 200 within a particular row is spaced approximately 0.06 in. from the adjacent teeth upon either side thereof within the same row. Each tooth 200 has a height of approximately 0.01 in. and a flat, rhombus-shaped, upper or outer, crest surface from which four identical sides extend at an angle of approximately 30 degrees relative to the radius of the traction wheel 60. In FIG. 4, the height of the teeth 200 is indicated by means of the dimension Y.

Figure 3:
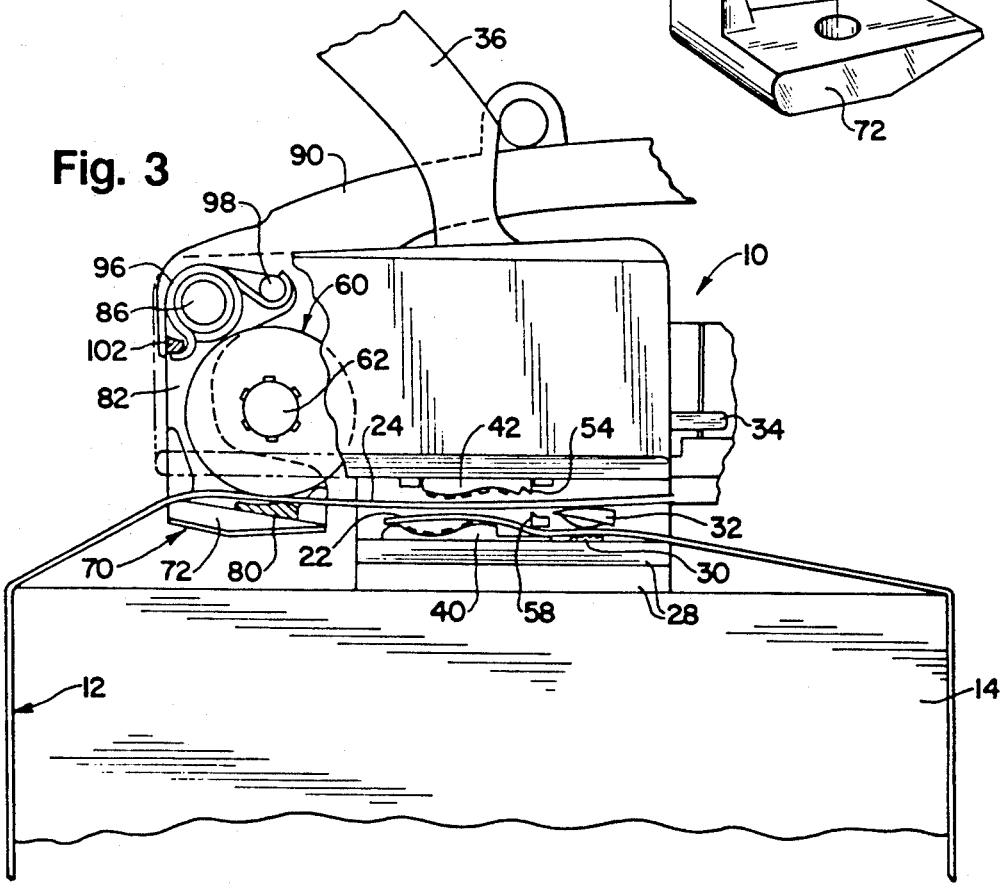
FIG. 3 is a greatly enlarged, exploded, perspective view of the tensioning foot and strap pressing member which are incorporated within the tension control mechanism of the present invention.

The configuration of the pressing member 80 is best illustrated in FIGS. 1 and 4. The pressing member 80 is adapted to press against the strap and has a pair of side strap guides or flanges 210 projecting upwardly upon either side of a partially cylindrical, concave surface 220, as best seen in FIG. 3. In this illustrated embodiment, the radius of the concave surface 220 is substantially equal to the radius of the traction wheel 60. The concave surface 220 terminates at one end thereof at a planar surface 226 which is angled away from the concave surface 220 so as to define a substantially line contact configuration or apex S for engaging the strap 12. Preferably, the strap engaging surface at and adjacent the line contact configuration S is polished to at least 16 micro-inches roughness average value in accordance with ANSI B 46.1-1978.

With reference to FIG. 4, the axis P of the shaft 86 (about which the tensioning foot 70 pivots) is located at a predetermined distance from the traction wheel rotational axis C. This is schematically illustrated in FIG. 4 wherein the pivot axis P of the tensioning foot 70 and the traction wheel rotational axis C define a plane designated by means of the reference letters PC. With this arrangement, the line contact configuration or apex S of the pressing member 80 is disposed closer to the surface of the traction wheel 60 as the tensioning foot 70 pivots under the influence of the torsion spring 96 (FIG. 2). The pivot radius is defined by means of the line segment PS.

In the illustrated preferred embodiment for use with the polyester strapping of the type described above, the distance defined between the tensioning foot axis P and the traction wheel axis C is approximately 1.22 in., the distance defined between the tensioning foot pivot axis P and the line contact configuration or apex S is approximately 1.97 in., the diameter of the traction wheel is approximately 1.50 in., and the radius of the concave pressing surface 220 is approximately 0.75 in.

Initially, when the strap trailing end portion 24 is positioned against the face of the traction wheel 60, but not pressed against it, the strap rests upon the crests of the traction wheel teeth 200. The tensioning foot 70 would be initially biased by means of the spring 96 against the strap to the position illustrated in solid lines in FIG. 4. The thickness of the strap projecting outwardly from the crests of the traction wheel teeth 200 is designated by means of the dimension Z'. In this position, the line contact configuration or apex S of the pressing member 80 is necessarily an equal distance Z' away from the crests of the teeth 200.

When the traction wheel 60 is rotated (in the counterclockwise direction about axis C as viewed in FIG. 4), the teeth 200 begin to engage the strap trailing end portion 24 and pull it (from left to right as viewed in FIG. 4) so as to tension the strap trailing end portion loop. As the strap 24 is engaged by means of the traction wheel teeth 200, the teeth dig into the strap which is being pressed against the teeth by means of the pressing member 80. The strap thus, in effect, moves closer to the traction wheel axis C. The pressing member 80, which is biased against the strap portion 24 by means of the torsion spring 96, follows the strap portion radially inwardly and therefore also moves closer to the traction wheel pivot axis C. As more tension is developed within the strap by means of the traction wheel 60, the traction wheel teeth 200 dig further into the strap.

For purposes of illustration, it is assumed that the traction wheel teeth 200 dig into the strap a distance equal to the full tooth height Y. In that case, the total inward movement X of the pressing member 80 would be equal to the tooth height Y plus the amount of any compression of the strap material. This is illustrated in phantom lines in FIG. 4 wherein the distance from the bottom of the teeth to the exterior surface of the strap portion 24 is designated by means of the reference letter Z". If there were little or no compression of the strap portion 24, the dimension Z" would be equal to the dimension Z'.

A sliding friction force is imposed upon the pressing member 80 by means of the sliding strap portion 24. This sliding friction force imposed upon on the member 80 tends to pull and pivot the pressing member 80 further toward the traction wheel 60 so as to compress the strap between the traction wheel 60 and the pressing member 80. This increased pressing or compressing force increases the oppositely acting sliding friction resistance force that is imposed upon the strap by means of the pressing member 80. Eventually, the sliding friction resistance force imposed upon the strap is great enough to overcome the tangential force imposed upon the strap by means of the traction wheel 60. This occurs at the maximum torque available to the traction wheel 60, and at this point the traction wheel rotation is terminated. In FIG. 4, the reference letter A designates the angular displacement of the tensioning foot 70 from the initial foot position shown in solid lines to a maximally moved position shown in dashed lines (when the traction wheel rotation terminates).

Depending upon the compressibility of the strap and the depth of the penetration of the teeth 200 into the strap, the distance X that the pressing member 80 moves inwardly may be less than, substantially equal to, or greater than the tooth height Y.

For a given application, the tool 10 is designed so that a predetermined maximum available torque is delivered to the traction wheel 60 by means of the motor and drive system. Then, for a predetermined strap width and for the selected coefficients of friction of the strap and of the pressing member 80, the diameter of the traction wheel 60 and the pivot radius PS of the tensioning foot 70 are selected so that the sliding friction resistance force imposed by means of the pressing member 80 upon the strap will overcome the traction wheel tangential force imposed upon the strap at the maximum available torque corresponding to the desired loop tension.

The novel tension control system of the present invention does not require the use of auxiliary control system, such as, for example, a pre-set tension spring, a limit switch responsive to movement of the tensioning foot, or an electrical or pneumatic control system responsive to an increased load upon the particular motor that is used within the tool. The present invention thus eliminates the need for more complex systems.

The traction control system of the present invention is particularly well-suited for use with tools intended to develop only relatively low levels of tension (that is, for example, 100 pounds force tension).

The tension control system of the present invention is also especially useful within tools employed to tension thermoplastic strapping and join the overlapping ends of the thermoplastic strapping with a friction-fusion weld wherein the weld is formed with a non-planar configuration as in the embodiment illustrated in FIG. 2. Specifically, with reference to FIG. 2, it is seen that the upper strap weld pad 42 has a wavy strap engaging surface with a convex portion and a concave portion. Similarly, the lower strap weld pad 40 has a wavy configuration with convex portions and a concave portion.

This type of wavy weld pad configuration is conventionally used upon the model VHT tool sold by Signode Corporation as previously identified. It will be appreciated that in order to effectively compress the overlapping strap portions between the wavy weld pads 40 and 42, sufficient slack must be present within the overlapping strap portions so as to allow the strap portions to be pressed together in conformity with the wavy configurations of the weld pads 40 and 42. To this end, the lower strap leading end portion 22 is always completely untensioned (because the loop tension terminates at the grippers 30 and 32). Similarly, the strap upper trailing end portion 24 which extends rearwardly of the traction wheel 60 beneath the upper weld pad 42 is not subjected to any tension (because the loop tension is not transmitted past the engagement of the strap 12 between the traction wheel 60 and the pressing member 80).

Thus, the tension control system of the present invention effectively operates upon only one portion of the strap so that the overlapping strap portions interposed between the weld pads 40 and 42 are untensioned and are free so as to be easily deformed to conform to the wavy configuration of the weld pads 40 and 42.

It will be readily observed from the foregoing detailed description of the invention and from the illustrated embodiment thereof that numerous variations and modifications may be effected without departing from the true spirit and scope of the novel concepts or principles of this invention. It is therefore to be understood that within the scope of the appended claims, the present invention may be practiced otherwise than as specifically described herein.

What is claimed is:

1. A method for tensioning a strap loop about an object, and terminating said tensioning of said strap loop at a predetermined loop tension, comprising the steps of:

encircling said object with a loop of strap having a predetermined thickness, width, and coefficient of friction, and restraining a leading portion of said strap while disposing a trailing portion of said strap adjacent a traction wheel that is rotatable about a first axis at a predetermined maximum available torque;

providing a smooth-surfaced pressing member that is pivotable about a second axis, which is oriented parallel to said first axis, and that has a predetermined configuration and coefficient of friction, and biasing said pressing member toward a peripheral portion of said traction wheel so as to press said strap trailing portion against said peripheral portion of said traction wheel, said predetermined configuration of said smooth-surfaced pressing member comprising an arcuate portion having a radial dimension which is substantially equal to the radial dimension of said traction wheel yet which is initially disposed, prior to tensioning of said strap, at an initial position at which said arcuate portion of said smooth-surfaced pressing member is not peripherally concentric with said peripheral portion of said traction wheel toward which said smooth-surfaced pressing member is biased, said arcuate portion of said smooth-surfaced pressing member terminating in an apex portion for defining a line contact portion for engaging said trailing portion of said strap and pressing said trailing portion of said strap toward said traction wheel, said apex portion of said smooth-surfaced pressing member being disposed within a plane, defined by said apex portion of said smooth-surfaced pressing member and said second axis of said smooth-surfaced pressing member, which is disposed angularly behind a plane, defined between said first and second axes of said traction wheel and said smooth-surfaced pressing member, as viewed in the direction of tensioning of said trailing portion of said strap; and rotating said traction wheel about said first axis so as to grip said strap and slide said strap along said pressing member for tensioning said strap loop about said object while permitting the sliding friction force imposed upon said pressing member to pivot said pressing member about said second axis and toward said traction wheel such that said line of contact apex portion of said smooth-surfaced pressing member moves radially inwardly toward said peripheral portion of said traction wheel, and said plane defined by means of said apex portion of said smooth-surfaced pressing portion and said second axis of said pressing member moves peripherally forwardly in said direction of tensioning of said trailing portion of said strap from said initial position toward said plane defined by said first and second axes of said traction wheel and said pressing member, as permitted by said peripheral non-concentricity of said traction wheel and said arcuate portion of said smooth-surfaced pressing member, so as to further compress said strap between said traction wheel and said pressing member and thereby increase the sliding friction resistance force imposed upon said strap so as to overcome the tangential force imposed upon said strap by said traction wheel at said maximum available torque and thereby terminate said traction wheel rotation at said predetermined loop tension.

2. The method in accordance with claim 1, further including locating said second axis so that the radial distance between said first axis and the circumference of said traction wheel is less than the shortest radial distance between said second axis and the portion of said pressing member engaged with said strap.

3. The method in accordance with claim 1, further including disposing said strap against said traction wheel so as to be engaged by teeth projecting from the periphery of the traction wheel.

4. The method as set forth in claim 1, wherein:

said strap comprises a polyester strap having a width of approximately 0.625 inches and a thickness of approximately 0.032 inches.

5. The method as set forth in claim 1, wherein:

said apex portion of said smooth-surfaced pressing member is polished to at least 16 micro-inches roughness average value.

6. The method as set forth in claim 1, wherein:

said radial dimensions of said traction wheel and said arcuate portion of said pressing member are approximately 0.75 inches.

7. A method for tensioning a strap loop about an object, and terminating the tensioning of said strap loop at a predetermined loop tension, comprising the steps of:

encircling said object with a loop of thermoplastic strap having a predetermined thickness, width, and coefficient of friction;

restraining a leading portion of said strap;

disposing a trailing portion of said strap adjacent a traction wheel that is rotatable about a first axis at a predetermined maximum available torque;

providing a smooth-surfaced pressing member that is pivotable about a second axis and which has a predetermined configuration for engaging said strap and pressing said strap toward and into contact with said traction wheel, and a predetermined coefficient of friction, said predetermined configuration of said smooth-surfaced pressing member comprising an arcuate portion having a radial dimension which is substantially equal to the radial dimension of said traction wheel yet which is initially disposed, prior to tensioning of said strap, at a first position at which said arcuate portion of said smooth-surfaced pressing member is not peripherally concentric with respect to a peripheral portion of said traction wheel toward which said smooth-surfaced pressing member is to be moved so as to press said strap portion into contact with said traction wheel, said arcuate portion of said smooth-surfaced pressing member terminating in an apex portion for defining a line contact portion for engaging said trailing portion of said strap and pressing said trailing portion of said strap toward said traction wheel, said apex portion of said smooth-surfaced pressing member being disposed within a plane, defined by said apex portion of said smooth-surfaced pressing member and said second axis of said smooth-surfaced pressing member, which is disposed angularly behind a plane, defined between said first and second axes of said traction wheel and said smooth-surfaced pressing member, as viewed in the direction of tensioning of said trailing portion of said strap;

biasing said pressing member toward said traction wheel so as to press said strap trailing portion against said peripheral portion of said traction wheel; and rotating said traction wheel about said first axis so as to grip said strap and slide said strap along said pressing member for tensioning said strap loop about said object while permitting the sliding friction force imposed upon said pressing member to pivot said pressing member about said second axis and toward said traction wheel such that said line of contact apex portion of said smooth-surfaced pressing member moves radially inwardly toward said peripheral portion of said traction wheel, and said plane defined by means of said apex portion of said smooth-surfaced pressing portion and said second axis of said pressing member moves peripherally forwardly in said direction of tensioning of said trailing portion of said strap from said first position toward said plane defined by means of said first and second axes of said traction wheel and said pressing member, as permitted by means of said peripheral non-concentricity of said traction wheel and said arcuate portion of said smooth-surfaced pressing member, so as to further compress said strap between said traction wheel and said pressing member and thereby increase the sliding friction resistance force imposed upon said strap so as to overcome the tangential forced imposed upon said strap by said traction wheel at said maximum available torque and thereby terminate said traction wheel rotation at said predetermined loop tension.

8. The method as set forth in claim 7, wherein:

said thermoplastic strap comprises a polyester strap having a width of approximately 0.625 inches and a thickness of approximately 0.032 inches.

9. The method as set forth in claim 7, wherein:

said apex portion of said smooth-surfaced pressing member is polished to at least 16 micro-inches roughness average value.

10. The method as set forth in claim 7, wherein:

said radial dimensions of said traction wheel and said arcuate portion of said pressing member are approximately 0.75 inches.

11. Apparatus for tensioning a loop formed about an object from strap having a predetermined thickness, width, and coefficient of friction, and for terminating the tensioning of, said strap loop at a predetermined loop tension, comprising:

a frame to be disposed adjacent to said object about which said loop is to be disposed;

a strap gripper disposed upon said frame for restraining a leading portion of said strap;

a traction wheel rotatable upon said frame about a first axis and disposed adjacent to a trailing portion of said strap;

a tension arm pivotably mounted upon said frame about a second axis oriented parallel to said first axis of said traction wheel and which has upon its distal end a smooth-surfaced pressing member having a predetermined configuration and coefficient of friction, said predetermined configuration of said smooth-surfaced pressing member comprising an arcuate portion having a radial dimension which is substantially equal to the radial dimension of said traction wheel yet which is initially disposed, prior to tensioning of said strap about said object, at a first position at which said arcuate portion of said smooth-surfaced pressing member is not peripherally concentric with respect to a peripheral portion of said traction wheel toward which said smooth-surfaced pressing member is to be moved so as to press said strap portion into contact with said traction wheel, said arcuate portion of said smooth-surfaced pressing member terminating in an apex portion defining a line contact portion for engaging said trailing portion of said strap and pressing said trailing portion of said strap toward said traction wheel, said apex portion of said smooth-surfaced pressing member being disposed within a plane, defined by said apex portion of said smooth-surfaced pressing member and said second axis of said smooth-surfaced pressing member, which id disposed angularly behind a plane, defined between said first and second axes of said traction wheel and said smooth-surfaced pressing member, as viewed in the direction of tensioning of said trailing portion of said strap;

a spring mounted between said frame and said tension arm for biasing said tension arm so as to pivot about said second axis and move said pressing member toward said traction wheel so as to press said strap trailing portion against said traction wheel; and a motor mounted upon said frame and drivably engaged with said traction wheel for rotating said traction wheel at a predetermined maximum available torque so as to grip said strap and slide said strap along said smooth-surfaced pressing member for tensioning said strap loop about said object while permitting the sliding friction force imposed upon said pressing member to pivot said pressing member about said second axis and toward said traction wheel such that said line of contact apex portion of said smooth-surfaced pressing member moves radially inwardly toward said peripheral portion of said traction wheel, and said plane defined by means of said apex portion of said smooth-surfaced pressing member and said second axis of said pressing member moves peripherally forwardly in said direction of tensioning of said trailing portion of said strap from said first position toward said plane defined by means of said first and second axes of said traction wheel and said pressing member, as permitted by means of said peripheral non-concentricity of said traction wheel and said arcuate portion of said smooth-surfaced pressing member, so as to further compress said strap between said traction wheel and said pressing member and thereby increase the sliding friction resistance force imposed upon said strap and overcome the tangential force imposed upon said strap by said traction wheel at said maximum available torque so as to terminate said traction wheel rotation at said predetermined loop tension.

12. The method as set forth in claim 11, wherein:

said strap comprises a polyester strap having a width of approximately 0.625 inches and a thickness of approximately 0.032 inches.

13. The apparatus as set forth in claim 11, wherein:

said apex portion of said smooth-surfaced pressing member is polished to at least 16 micro-inches roughness average value.

14. The apparatus as set forth in claim 11, wherein:

said radial dimensions of said traction wheel and said arcuate portion of said pressing member are approximately 0.75 inches.

15. Apparatus for tensioning a loop formed about an object from strap having a predetermined thickness, width, and coefficient of friction, and for terminating the tensioning of said strap loop at a predetermined loop tension, comprising:

restraining means for restraining a leading portion of said strap;

a traction wheel rotatable about a first axis and disposed adjacent to a trailing portion of said strap;

a smooth-surfaced pressing member pivotably mounted about a second axis oriented parallel to said first axis of said traction wheel and which has a predetermined configuration and coefficient of friction, said predetermined configuration of said smooth-surfaced pressing member comprising an arcuate portion having a radial dimension which is substantially equal to the radial dimension of said traction wheel yet which is initially disposed, prior to tensioning of said strap about said object, at a first position at which said arcuate portion of said smooth-surfaced pressing member is not peripherally concentric with respect to a peripheral portion of said traction wheel toward which said smooth-surfaced pressing member is to be moved so as to press said strap portion into contact with said traction wheel, said arcuate portion of said smooth-surfaced pressing member terminating in an apex portion defining a line contact portion for engaging said trailing portion of said strap and pressing said trailing portion of said strap toward said traction wheel, said apex portion of said smooth-surfaced pressing member being disposed within a plane, defined by said apex portion of said smooth-surfaced pressing member and said second axis of said smooth-surfaced pressing member, which is disposed angularly behind a plane, defined between said first and second axes of said traction wheel and said smooth-surfaced pressing member, as viewed in the direction of tensioning of said trailing portion of said strap;

biasing means for biasing said pressing member toward said traction wheel so as to press said strap trailing portion against said traction wheel; and motor means operatively connected to said traction wheel for rotating said traction wheel at a predetermined maximum available torque so as to grip said strap and slide said strap along said smooth-surfaced pressing member for tensioning said strap loop about said object while permitting the sliding friction force imposed upon said smooth-surfaced pressing member to pivot said smooth-surfaced pressing member about said second axis and toward said traction wheel such that said line of contact apex portion of said smooth-surfaced pressing member moves radially inwardly toward said peripheral portion of said traction wheel, and said plane defined by means of said apex portion of said smooth-surfaced pressing member and said second axis of said pressing member moves peripherally forwardly in said direction of tensioning of said trailing portion of said strap from said first position toward said plane defined by means of said first and second axes of said traction wheel and said pressing member, as permitted by means of said peripheral non-concentrically of said traction wheel and said arcuate portion of said smooth-surfaced pressing member, so as to further compress said strap between said traction wheel and said pressing member and thereby increase the sliding friction resistance force imposed upon said strap and thus overcome the tangential force imposed upon said strap by said traction wheel at said maximum available torque so as to terminate said traction wheel rotation at said predetermined loop tension.

16. The apparatus in accordance with claim 15 in which said second axis is located so that the radial distance defined between said first axis and the circumference of said traction wheel is less than the shortest radial distance defined between said second axis and the portion of sadi pressing member engaged with said strap.

17. The apparatus in accordance with claim 15 in which said traction wheel defines a generally cylindrical peripheral configuration and has outwardly projecting teeth for engaging said strap.

18. The apparatus in accordance with claim 15 in which the diameter of the traction wheel is approximately 1.5 inch;

the traction wheel defines a generally cylindrical surface having outwardly projecting teeth arranged in an array of rows in which the rows are spaced apart by approximately 0.06 inch, each tooth in a row being spaced approximately 0.06 inch from the adjacent teeth on either side in the same row, and each tooth having a height of approximately 0.01 inch; and said pressing member has a strap-engaging surface that is polished to at least 16 micro-inches roughness average value.

19. The apparatus in accordance with claim 15 in which the distance defined between said first and second axes is approximately 1.22 inch;

the distance defined between said second axis and the closest part of said pressing member that contacts said strap is approximately 1.97 inch; and the diameter of said traction wheel is approximately 1.50 inch.

20. The apparatus in accordance with claim 19 in which said pressing member defines a partially cylindrical, concave surface having a radius of approximately 0.75 inch terminating on one end at a planar surface angled away from said concave surface so as to define said line contact portion.

21. The method as set forth in claim 15, wherein:

said strap comprises a polyester strap having a width of approximately 0.625 inches and a thickness of approximately 0.032 inches.

* * * * *